US008245552B2

(12) United States Patent
Murakami et al.

(10) Patent No.: US 8,245,552 B2
(45) Date of Patent: Aug. 21, 2012

(54) PROCESS FOR PRODUCING HIGH-ALLOY SEAMLESS TUBE

(75) Inventors: Hiroaki Murakami, Osaka (JP); Tomio Yamakawa, Osaka (JP); Tadashi Douhara, Osaka (JP); Masayuki Sagara, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/954,223

(22) Filed: Nov. 24, 2010

(65) Prior Publication Data

US 2011/0067475 A1 Mar. 24, 2011

Related U.S. Application Data

(63) Continuation of application No. PCT/JP2009/060229, filed on Jun. 4, 2009.

(30) Foreign Application Priority Data

Jun. 13, 2008 (JP) ..... 2008-155808

(51) Int. Cl.

| | |
|---|---|
| ***B21C 23/00*** | (2006.01) |
| ***B21C 23/04*** | (2006.01) |
| ***B21C 31/00*** | (2006.01) |
| ***B21C 1/00*** | (2006.01) |

(52) U.S. Cl. ..... 72/253.1; 72/264; 72/271; 72/700

(58) Field of Classification Search ..... 72/253.1, 72/264, 271, 268, 700

See application file for complete search history.

(56) References Cited

U.S. PATENT DOCUMENTS

| | | | | |
|---|---|---|---|---|
| 3,749,612 | A * | 7/1973 | Benjamin et al. | 419/28 |
| 6,918,968 | B2 * | 7/2005 | Semba et al. | 148/327 |

FOREIGN PATENT DOCUMENTS

| | | | |
|---|---|---|---|
| JP | 58-006927 | A | 1/1983 |
| JP | 63-274743 | A | 11/1988 |
| JP | 5-261427 | A | 10/1993 |
| JP | 11-302801 | A | 11/1999 |
| JP | 2004-174536 | A | 6/2004 |

OTHER PUBLICATIONS

International Search Report in corresponding PCT/JP2009/060229, dated Aug. 11, 2009 (English and Japanese).
Written Opinion in corresponding PCT/JP2009/060229, dated Aug. 11, 2009 (Japanese only).
International Preliminary Report on Patentability for PCT/JP2009/060229, dated Jan. 11, 2011.

* cited by examiner

*Primary Examiner* — Dana Ross
*Assistant Examiner* — Mohammad I Yusuf
(74) *Attorney, Agent, or Firm* — Marshall, Gerstein & Borun LLP

(57) ABSTRACT

A starting material to be extruded made of a high alloy comprising, in mass %, Cr: 20 to 30% and Ni: more than 22% and 60% or less is heated to a temperature predetermined according to the contents of Mo and W and is subjected to a hot-extrusion process, the heating temperature T (° C.) satisfying a relationship of Formula (1), (2), or (3), which is expressed in terms of the average cross-sectional area A ($mm^2$) of the starting material to be extruded, the extrusion ratio EL (–), and the extrusion speed V (mm/s). As a result, a high-alloy seamless tube can be produced without generating cracking and/or seam flaws.

When $0\% \leqq Mo+0.5W < 4\%$: $T \leqq 1343-0.001322\times A-1.059\times EL-0.129\times V$ (1)

When $4\% \leqq Mo+0.5W < 7\%$: $T \leqq 1316-0.001322\times A-1.059\times EL-0.129\times V$ (2)

When $7\% \leqq Mo+0.5W$: $T \leqq 1289-0.001322\times A-1.059\times EL-0.129\times V$ (3)

17 Claims, 1 Drawing Sheet

PROCESS FOR PRODUCING HIGH-ALLOY SEAMLESS TUBE

TECHNICAL FIELD

The present invention relates to a hot extrusion process for producing a tube from a high-alloy hollow billet by a hot extrusion tube-making process. More particularly, the present invention relates to a process for producing a high-alloy seamless tube by hot extrusion without generating cracking and/or seam flaws using a starting material to be extruded made of a high alloy having a high deformation resistance.

BACKGROUND ART

In recent years, service conditions for oil well tubes and boiler tubes are getting much more hostile. For this reason, requirements for seamless tubes to be used therefore are becoming more rigorous. For example, oil well tubes used for deeper oil wells and more corrosive environment are required to have higher strength and better corrosion resistance. On the other hand, tubes used in nuclear power generation facilities, chemical plants, and the like are required to be excellent in corrosion resistance, particularly in stress corrosion cracking resistance in high temperature pure water or hot water containing chlorine ions ($Cl^-$). From these requirements, a seamless tube made of a high alloy containing a large amount of Cr and Ni, and also Mo is being applied.

For example, Patent Document 1 discloses a high Cr-high Ni alloy which contains Cr: 20 to 35%, Ni: 25 to 50%, Cu: 0.5 to 8.0%, Mo: 0.01 to 3.0% and sol. Al: 0.01 to 0.3% and in which the contents of Cu and Mo satisfy a relationship represented by: $\% Cu \geqq 1.2-0.4(\% Mo-1.4)^2$, as a high alloy for seamless tubes having high strength and being excellent in corrosion resistance and hot workability, the seamless tubes being used for deep wells and oil wells or gas wells (hereinafter, simply referred to as "oil wells") in severe corrosive environments.

As a process for producing seamless tubes, employed are processes in which a billet as being a high-alloy starting material to be extruded is used to make a high-alloy tube applying a hot rolling process such as a hot extrusion tube-making process represented by the Ugine-Sejournet process or the like, and the Mannesmann tube-making process.

FIG. 1 is a sectional view for describing a hot extrusion tube-making process used for producing a seamless tube. A billet 8 with a through hole along the longitudinal centerline (in the present specification, simply referred to as a "hollow billet" or a "billet") is placed in a container 6, and a die 2 is detachably fitted to one end of the container 6 by the intervention of a die holder 4 and a die backer 5. A mandrel 3 is inserted into the through hole of the billet 8, and a dummy block 7 is arranged on the rear end surface thereof.

In such a configuration, when the dummy block 7 is pressed in the direction of a white arrow by actuating a stem which is not shown, the hollow billet 8 is upset and then extruded from the annular space formed by the inner surface of the die 2 and the outer surface of the mandrel 3, producing a seamless tube having an outside diameter corresponding to the inside diameter of the die 2 and an inside diameter corresponding to the outside diameter of the mandrel 3. In the production of the seamless tube, a hollow glass disk lubricant 1 is placed between the die 2 and the hollow billet 8 in order to lubricate between the inner surface of the die 2 and the front end surface and the outer surface of the hollow billet 8.

In addition to the Patent Document 1, the prior art in which a hot extrusion process is applied to the production of high-alloy tubes includes the following. Patent Document 2 describes that a billet made of an alloy in which the contents of Cr, Mo, W and the like are specified has been subjected to hot extrusion processing to form a blank tube having an outside diameter of 60 mm and a wall thickness of 4 mm, which has been then subjected to heat treatment and cold working to produce, for test evaluation, an alloy tube excellent in stress corrosion cracking resistance. Patent Document 3 describes that an alloy in which the contents of Cr, Ni, Mo, Al, Ca, S, O, and the like are specified has been subjected to a hot extrusion tube-making process to produce a blank tube. The Patent Document 1 also describes that the billet made of the above high Cr-high Ni alloy has been used to form a tube having a diameter of 60 mm and a wall thickness of 5 mm by hot extrusion tube-making represented by the Ugine-Sejournet process.

However, the Patent Documents as described above only disclose that hot extrusion has been performed, and no document discloses the findings in which processing-incurred heat, occurring during hot extrusion of an alloy having a high deformation resistance, is taken into consideration, with respect to the suppression of cracking and/or seam flaws incurred by grain boundary melting.

CITATION LIST

Patent Document

Patent Document 1: Japanese Patent Application Publication No. 11-302801 (claims, and paragraphs [0009] to [0012], and [0047])

Patent Document 2: Japanese Patent Application Publication No. 58-6927 (claims, and from line 13 in the lower left column to line 10 in the upper right column of page 7)

Patent Document 3: Japanese Patent Application Publication No. 63-274743 (claims, and from line 6 in the lower right column of page 5 to line 12 in the upper left column of page 6)

SUMMARY OF INVENTION

Technical Problem

As described above, the deformation resistance of a high alloy such as a high Cr-high Ni alloy is very high as being about two to three times as that of, for example, S45C, at the same temperature, and the degree of the temperature increase inside the tube wall is intensified by processing-incurred heat during extrusion. In the conventional hot extrusion techniques, the temperature increase during extrusion causes grain boundary melting cracking within the tube wall, which appears as the seam flaw on a tube inner peripheral surface, causing a problem such as generating product defectives frequently.

The present invention has been made in light of the above-described problems, and the object of the present invention is to provide a process for producing a high-alloy seamless tube by hot extrusion without generating cracking and/or seam flaws using a starting material to be extruded made of a high alloy having a high deformation resistance.

Solution to Problem

In order to solve the above problem, the present inventors have investigated a process for producing a high-alloy seamless tube which can prevent generation of cracking and/or seam flaws during hot extrusion using a starting material to be extruded made of a high alloy having a high deformation resistance, and have completed the present invention by obtaining the main findings (a) to (c) described below.

(a) There is a correlation between the cross-sectional area of the starting material to be extruded made of a high alloy such as a high Cr-high Ni alloy having a high deformation resistance and the rate of occurrence of inner surface flaws of an extruded tube resulting from processing-incurred heat, and the rate of occurrence of inner surface flaws increases with the increase in the cross-sectional area of the starting material to be extruded. This relationship is obtained because the degree of temperature increase within the tube wall increases with the increase in the cross-sectional area of the starting material to be extruded, resulting in the occurrence of grain boundary melting cracking within the tube wall by the temperature increase during extrusion, which appears as seam flaws on the tube inner peripheral surface. In addition to this, the degree of the temperature increase within the tube wall as described above increases also by the increase in the extrusion speed and the increase in the extrusion ratio, and by the increase in the deformation resistance as well.

(b) Therefore, it is possible to suppress the temperature increase within the tube wall due to excessive processing-incurred heat and prevent occurrence of seam flaws on the tube inner peripheral surface resulting from grain boundary melting cracking, by controlling the heating temperature of the starting material to be extruded made of a high alloy having a high deformation resistance depending on extrusion conditions such as the cross-sectional area of the starting material to be extruded, the extrusion speed, and the extrusion ratio.

(c) When a high alloy contains Mo and W, the deformation resistance of the starting material to be extruded becomes much higher to thereby increase the processing-incurred heat. Therefore, it is necessary to formulate the conditions of heating temperature using the cross-sectional area of the starting material to be extruded, the extrusion speed, and the extrusion ratio according to the contents of Mo and W represented by (Mo+0.5W), and to control the heating temperature of the starting material to be extruded within the range which satisfies such conditional expressions.

The present invention has been completed based on the findings as described above, and the gist thereof consists in a process for producing a high-alloy seamless tube disclosed in the following (1) to (8).

(1) A process for producing a high-alloy seamless tube, wherein a starting material to be extruded made of a high alloy containing, in mass %, Cr: 20 to 30% and Ni: more than 22% and 60% or less is heated to a temperature predetermined according to the contents of Mo and W and subjected to hot extrusion, the heating temperature (T) satisfying the relationship of Formula (1), (2), or (3) as below, which is expressed in terms of the average cross-sectional area (A) of the starting material to be extruded, the extrusion ratio (EL), and the extrusion speed (V).

When 0%≦Mo+0.5W<4%, $$T \leqq 1343 - 0.001322 \times A - 1.059 \times EL - 0.129 \times V \quad (1);$$

when 4%≦Mo+0.5W<7%, $$T \leqq 1316 - 0.001322 \times A - 1.059 \times EL - 0.129 \times V \quad (2); \text{ and}$$

when 7%≦Mo+0.5W, $$T \leqq 1289 - 0.001322 \times A - 1.059 \times EL - 0.129 \times V \quad (3),$$

where A and EL in Formulae (1) to (3) are determined by the following Formulae (4) and (5):

$$A = \pi \times t_0 \times (d_0 - t_0) \quad (4); \text{ and}$$

$$EL = L_1 / L_0 \quad (5).$$

Here, symbols each in the above Formulae (1) to (5) represents following quantity:

Mo: Mo content in the starting material to be extruded (mass %),

W: W content in the starting material to be extruded (mass %),

T: Heating temperature of the starting material to be extruded (° C.),

A: Average cross-sectional area of the starting material to be extruded ($mm^2$), EL: Extrusion ratio (−), V: Extrusion speed (mm/s), $d_0$: Average outside diameter of the starting material to be extruded (mm), $t_0$: Average wall thickness of the starting material to be extruded (mm), $L_0$: Length of the starting material to be extruded (mm), and $L_1$: Length of the extruded tube (mm).

(2) The process for producing a high-alloy seamless tube according to the (1), wherein the heating temperature of the starting material to be extruded is 1130° C. or more.

(3) The process for producing a high-alloy seamless tube according to the (1) or (2), wherein the extrusion is carried out under the condition that the average extrusion speed from the start of extrusion to the completion thereof is in the range of 80 mm/s or more to 200 mm/s or less.

(4) The process for producing a high-alloy seamless tube according to any of the (1) to (3), wherein the extrusion ratio is 10 or less.

(5) The process for producing a high-alloy seamless tube according to any of the (1) to (4), wherein the length of the starting material to be extruded is 1.5 m or less.

(6) The process for producing a high-alloy seamless tube according to any of the (1) to (5), wherein the outer surface temperature of the starting material to be extruded is 1000° C. or more.

(7) The process for producing a high-alloy seamless tube according to any of the (1) to (6), wherein the starting material to be extruded contains, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisting of Mo: 11.5% or less and W: 20% or less, the balance being Fe and impurities.

(8) The process for producing a high-alloy seamless tube according to the (7), wherein the starting material to be extruded contains instead of a part of Fe, in mass %, one or more elements selected from a group consisting of Ca: 0.01% or less, Mg: 0.01% or less, and rare earth metals: 0.2% or less.

In the present invention, a "high alloy" means a multi-component alloy containing Cr: 20 to 30 mass %, Ni: more than 22 mass % and 60 mass % or less, and optionally one or two elements selected from a group consisted of Mo and W, the balance being Fe and impurities. Further, rare earth metals mean 17 elements including Y and Sc in addition to 15 lanthanoid elements.

In the following description of the present specification, "%" representing the content of alloy element means "mass %".

Advantageous Effects of Invention

According to the process for producing a high-alloy seamless tube of the present invention, a starting material to be extruded made of a high alloy having a high deformation resistance is heated to a temperature and extruded, the heating temperature being determined according to the contents of Mo and W and satisfying a conditional expression of the heating temperature in terms of the cross-sectional area of the starting material to be extruded, the extrusion speed, and the extrusion ratio. As a result, it is possible to prevent the occurrence of seam flaws on the tube inner peripheral surface resulting from grain boundary melting cracking and produce a high-alloy seamless tube having good inner surface qualities.

DESCRIPTION OF EMBODIMENTS

As described above, the process of the present invention is the one for producing a high-alloy seamless tube, wherein a starting material to be extruded made of a high alloy containing Cr: 20 to 30% and Ni: more than 22% and 60% or less is heated to a temperature predetermined according to the contents of Mo and W and subjected to hot extrusion, the temperature satisfying the relationship represented by the formula (1), (2), or (3), which is expressed in terms of the average cross-sectional area of the starting material to be extruded, the extrusion ratio, and the extrusion speed. Hereinafter, reasons for having specified the process of the present invention as described above and preferred embodiments of the present invention will be described in detail.

1. Conditions of Hot Extrusion 1-1. Heating Conditions of Starting Material to be Extruded The reason for having specified the relationship expressed with the formulas (1) to (3) in the process of the present invention will be described below.

Using a high alloy wherein the composition of main elements thereof is Ni: 52%, Cr: 22%, Mo: 10.3%, and W: 0.5%, starting materials to be extruded are prepared, in which the average outside diameter ($d_0$) and the average wall thickness ($t_0$) were varied. These starting materials to be extruded were heated to 1210° C. and subjected to hot extrusion test to investigate a relationship between each test condition and the rate of occurrence of inner surface flaws in extruded tubes.

Table 1 shows the test conditions and the rate of occurrence of inner surface flaws in extruded tubes.

TABLE 1

| Dimension of starting material to be extruded | | | Dimension of extruded tube | | | Rate of occurrence |
|---|---|---|---|---|---|---|
| Average outside diameter $d_0$ (mm) | Average wall thickness $t_0$ (mm) | Average cross-sectional area A ($mm^2$) | Outside diameter $d_1$ (mm) | Wall thickness $t_1$ (mm) | Extrusion ratio EL (—) | of inner surface flaws (%) |
| 213 | 59.9 | 28811 | 109 | 9.5 | 9.7 | 2 |
| 213 | 57 | 27935 | 113 | 9 | 9.5 | 0 |
| 257.5 | 70 | 41233 | 132 | 19 | 6.1 | 12 |
| 257.5 | 80.2 | 44672 | 132 | 21 | 6.1 | 23 |
| 295.5 | 78.05 | 53319 | 191 | 28 | 3.8 | 25 |
| 295.5 | 68.45 | 48825 | 193 | 19 | 4.7 | 20 |
| 330 | 65 | 54114 | 193 | 25 | 4.1 | 22 |

In Table 1, the "rate of occurrence of inner surface flaws" is defined as a value, represented by percentage (%), obtained by dividing the number of seamless tubes which have flaws resulting from grain boundary melting on their inner surfaces, among 500 to 1000 seamless tubes produced in the hot extrusion test, by the number of total produced seamless tubes.

Figure 1:
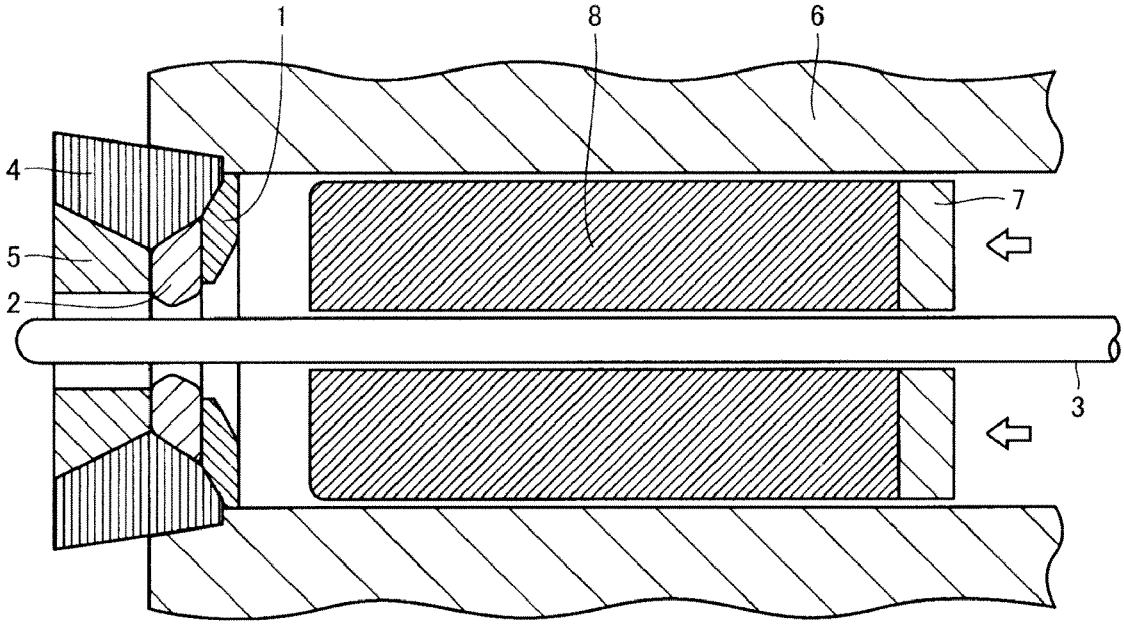
FIG. 1 is a sectional view for describing a hot extrusion tube-making process used for producing a seamless tube.
Figure 2:
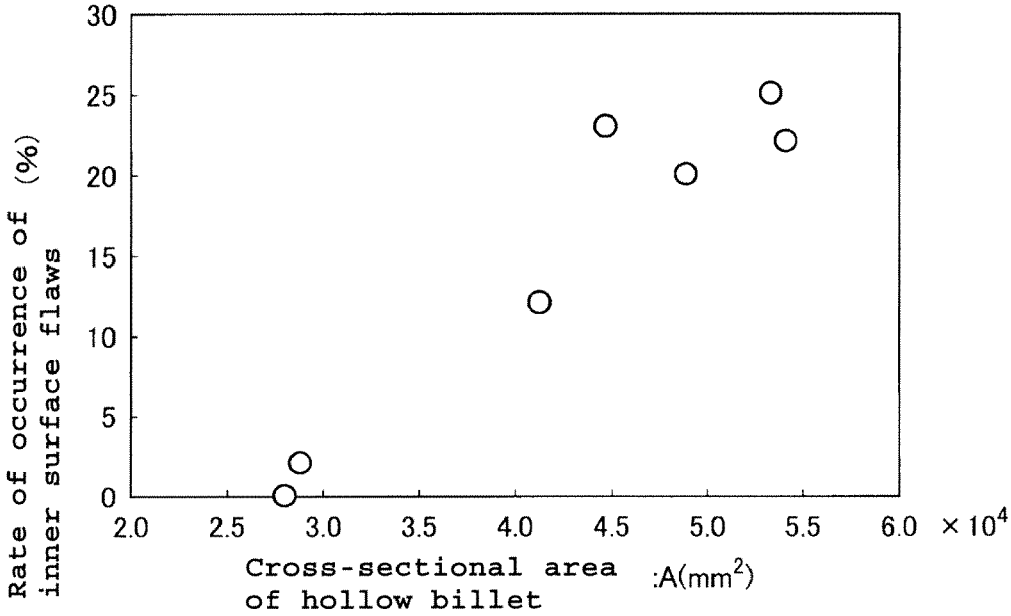
FIG. 2 is a view showing a relationship between the cross-sectional area of a hollow billet and the rate of occurrence of inner surface flaws of an extruded tube.

Based on the results shown in Table 1, the relationship between the average cross-sectional area of a hollow billet and the rate of occurrence of inner surface flaws of an extruded tube was shown in FIG. 2.

The following findings were obtained from the results of Table 1 and FIG. 2.

(1) The rate of occurrence of inner surface flaws in tubes increases as the average cross-sectional area of the starting material to be extruded increases. This is because the degree of temperature increase within the tube wall increases with the increase in processing-incurred heat, resulting in the occurrence of grain boundary melting cracking within the tube wall by the temperature increase during extrusion, which appears as seam flaws on the tube inner peripheral surface.

(2) In addition to the above (1), the degree of temperature increase within the tube wall by processing-incurred heat is intensified with the increase in extrusion speed of the starting material to be extruded, with the increase in extrusion ratio thereof, and further with the increase in deformation resistance of the starting material to be extruded.

(3) Referring to the above (1) and (2), it is possible to prevent the temperature increase within the tube wall due to excessive processing-incurred heat and to prevent the occurrence of flaws on the tube inner peripheral surface resulting from grain boundary melting cracking by controlling the heating temperature of the starting material to be extruded made of a high alloy of high Cr-high Ni having a high deformation resistance depending on extrusion conditions.

(4) Further, when a high alloy contains Mo and W, the deformation resistance is further heightened to increase the processing-incurred heat. Therefore, it is necessary to formulate the conditions of heating temperature using the cross-sectional area of the starting material to be extruded, the extrusion ratio, and the extrusion speed according to the contents of Mo and W represented by (Mo+0.5W), and to control the heating temperature of the starting material to be extruded within the range which satisfies the above conditional expressions.

The heating conditions were formulated based on the above findings (1) to (4) and the results of Examples described below, obtaining the conditional expressions of heating temperature represented by the above formulas (1) to (3).

Further, the heating temperature of the starting material to be extruded is preferably 1130° C. or more. The reason is as follows.

If a billet as being a starting material to be extruded is extruded at a heating temperature of less than 1130° C., the inner surface temperature of the extruded tube after extrusion may be a lower temperature of 1000° C. or less by the cooling of the billet effected by a mandrel bar which is an inner surface restraining tool. As a result, a large amount of inner surface flaws are likely to occur in the extruded tube due to the reduction in ductility of the tube material. In addition, the load during extrusion significantly increases to augment the risk of causing damage to equipments. Therefore, the heating temperature is preferably 1130° C. or more.

1-2. Average Extrusion Speed

The average extrusion speed from the start of extrusion to the completion thereof is preferably 80 mm/s or more and 200 mm/s or less. The reason is as follows.

If the average extrusion speed is less than 80 mm/s, the productivity of extruded tubes may be reduced to pose a problem in actual operation. Therefore, the average extrusion speed is preferably 80 mm/s or more. On the other hand, if the average extrusion speed increases to a level exceeding 200 mm/s, an excessive equipment capacity is required, which may reduce economical efficiency. Therefore, the average extrusion speed is preferably 200 mm/s or less.

1-3. The Extrusion Ratio, and the Length and the Outer Surface Temperature of a Starting Material to be Extruded The extrusion ratio is preferably 10 or less. This is because if the extrusion ratio is as high as exceeding 10, the inner surface seam flaws resulting from grain boundary melting may occur at a higher frequency due to an increase in processing-incurred heat with increasing throughput.

The length of the starting material to be extruded is preferably 1.5 m or less. This is because if the length of the starting material to be extruded exceeds 1.5 m, a billet as being the starting material to be extruded may be subject to buckling or bending during extrusion.

Further, the outer surface temperature of the starting material to be extruded (billet) before extrusion is preferably 1000° C. or more. This is because if the starting material to be extruded is extruded at an outer surface temperature of less than 1000° C., more cracking, seam flaws and/or the like may occur due to reduction in ductility of the tube material.

2. Chemical Composition of Starting Material to be Extruded Made of High Alloy

Cr: 20 to 30%

Cr is an effective element for improving hydrogen sulfide corrosion resistance typified by stress corrosion cracking resistance in case of the co-existence of Ni. However, if the Cr content is less than 20%, this effect cannot be achieved. On the other hand, if the Cr content exceeds 30%, the effect saturates, and such is undesirable from the viewpoint of hot workability. Therefore, the pertinent range of the Cr content is defined as 20 to 30%. The preferable range of the Cr content is 22 to 28%.

Ni: More than 22% and 60% or Less

Nickel is an element having a function of improving hydrogen sulfide corrosion resistance. However, if the content is 22% or less, a Ni sulfide film may not be sufficiently produced on the outer surface of alloy. Therefore, the effect of incorporating Ni cannot be achieved. On the other hand, even if Ni is incorporated at a content of more than 60%, the effect saturates. Therefore, the effect matching with alloy cost cannot be obtained, thereby reducing economical efficiency. Therefore, the pertinent range of the Ni content is defined as more than 22% and 60% or less. The preferable range of the Ni content is 25 to 40%.

Mo and W

Mo and W may or may not be incorporated. Both of these elements are ones having a function of improving pitting resistance, and for achieving the effect, one or two selected from Mo: 11.5% or less and W: 20% or less can be incorporated. The preferred lower limit when these elements are incorporated is 1.5% in terms of (Mo+0.5W). Even if these elements are incorporated in an amount more than needed, the effect merely saturates. Excessively containing these reduces the hot workability of a starting material to be extruded. Therefore, Mo and W are preferably incorporated in an amount in the range of 20% or less in terms of (Mo+0.5W).

As described above, the preferred upper limits of the contents of Mo and W are specified as 11.5% for Mo and 20% for W. The reason is that if the contents of the elements are within these limits, the hot workability of a starting material to be extruded can be ensured. This is desirable.

On the other hand, Mo and W can heighten the deformation resistance of the high alloy in the present invention. Therefore, when these elements are incorporated, the degree of the temperature increase within the tube wall will become higher by the processing-incurred heat during hot extrusion. The temperature increase during extrusion causes grain boundary melting cracking within the tube wall, which appears as seam flaws on a tube inner peripheral surface, being likely to cause product defectives. For the reason as described above, in the present invention, the lower limits of the heating temperature of a starting material to be extruded have been specified by Formulae (1) to (3) according to the contents of Mo and W as described above.

C: 0.04% or Less

If the content of C exceeds 0.04%, Cr carbides may be formed in crystal grain boundaries of a high alloy, increasing the susceptibility to stress corrosion cracking in grain boundaries. For this reason, the C content is preferably 0.04% or less, more preferably 0.02% or less.

Si: 1.0% or Less

Si is an element effective as a deoxidizer of a high alloy and can be optionally incorporated. However, if the content of Si exceeds 1.0%, hot workability may be reduced. Therefore, the Si content is preferably 1.0% or less, more preferably 0.5% or less.

Mn: 0.01 to 5.0%

Mn is an element effective as a deoxidizer of a high alloy similar to Si described above, and the effect of Mn can be obtained at a content of 0.01% or more. However, if the content exceeds 5.0%, hot workability tends to be reduced. Further, when N which is effective for increasing the strength is incorporated in an amount as high as 0.5%, pinholes are likely to be generated near the surface of the alloy during solidification after melting. Therefore, it is preferable to allow Mn, which has the effect on increasing the solubility of N, to be incorporated, and the upper limit of the Mn content is specified as 5.0%. For this reason, when Mn is incorporated, the content is preferably in the range of 0.01 to 5.0%, more preferably 0.3 to 3.0%, yet more preferably 0.5 to 1.5%.

P: 0.03% or Less

P is contained as an impurity in a high alloy, but if the content exceeds 0.03%, the susceptibility to stress corrosion cracking in a hydrogen sulfide environment may be increased. For this reason, the P content is preferably 0.03% or less, more preferably 0.025% or less.

S: 0.03% or Less

S is contained as an impurity in a high alloy similar to P described above, but if the content exceeds 0.03%, the hot workability may be significantly reduced. For this reason, the S content is preferably 0.03% or less, more preferably 0.005% or less.

Cu: 0.01 to 4.0%

Cu is an element having a function of significantly improving the hydrogen sulfide corrosion resistance in a hydrogen sulfide environment. Therefore, Cu is preferably incorporated in an amount of 0.01% or more. However, if the content exceeds 4.0%, the above effect saturates, and conversely, hot workability may be reduced. For this reason, the Cu content is preferably in the range of 0.01 to 4.0%. The Cu content is more preferably in the range of 0.2 to 3.5%.

Al: 0.001 to 0.30%

Al is an element effective as a deoxidizer of a high alloy. Al is preferably incorporated in an amount of 0.001% or more for immobilizing oxygen in a high alloy so that oxides of Si or Mn harmful to hot workability may not be produced. However, if the content exceeds 0.30%, the hot workability may be reduced. For this reason, the Al content is preferably in the range of 0.001 to 0.30%. The Al content is more preferably in the range of 0.01 to 0.20%.

N: 0.005 to 0.50%

N is a solid-solution strengthening element of a high alloy, and it contributes not only to the increase in strength, but also to the improvement in toughness by suppressing the formation of intermetallic compounds such as sigma (σ) phase. For this reason, N is preferably incorporated in an amount of 0.005% or more. Further, a high alloy tube having a higher strength can be obtained after solid solution heat treatment by positively incorporating N. However, if the content exceeds 0.50%, not only hot workability is reduced, but pinholes are likely to be generated near the surface of the alloy during solidification after melting. In addition, the pitting resistance may deteriorate. For this reason, the N content is preferably in the range of 0.005 to 0.50%. The N content is more preferably in the range of 0.06 to 0.30%, yet more preferably in the range of 0.06 to 0.22%. Note that when higher strength is desired, the lower limit of the N content is preferably 0.16%.

One or more selected from Ca: 0.01% or less, Mg: 0.01% or less, and rare earth metals: 0.2% or less These compositional elements can be optionally incorporated in the high alloy, and when they are incorporated, the effect of improving hot workability can be achieved. However, if the content of each of Ca and Mg exceeds 0.01%, coarse oxides will be formed, and if the content of rare earth metals exceeds 0.2%, coarse oxides will be formed, thereby causing reduction in hot workability. For this reason, the content of each of Ca and Mg is preferably 0.01% or less, and the content of rare earth metals is preferably 0.2% or less.

In order to securely obtain the improvement effect on hot workability by incorporating these elements, Ca and Mg are each preferably incorporated in an amount of 0.0005% or more, and rare earth metals are preferably incorporated in an amount of 0.001% or more.

The high alloy tube of the present invention is a tube made of a high alloy which contains the essential elements as described above and optionally further contains optional elements, the balance being Fe and impurities. This tube can be produced by production facilities and production processes commonly used in the industry. For example, for the melting of the high alloy, an electric furnace, an argon-oxygen mixed gas bottom blowing decarburization furnace (AOD furnace), a vacuum decarburization furnace (VOD furnace) or the like can be used.

The molten metal obtained by melting may be cast into ingots by an ingot-making process followed by rolling into billets, or may be cast into a rod-like, a string of billet by a continuous casting process. These billets can be used as a starting material to produce a high-alloy seamless tube by an extrusion tube-making process such as the Ugine-Sejournet process. Then, the extruded tube obtained by hot extrusion may be subjected to solution heat treatment followed by cold working such as cold rolling and cold drawing.

EXAMPLES

In order to confirm the effect of the process for producing a high-alloy seamless tube according to the present invention, the hot extrusion tests described below were performed and the results were evaluated.

Four types of high alloys having main components and composition shown in the following (a) to (d) were used for the tests.

(a) Ni: 31%, Cr: 25%, Mo: 2.9%, W: 0.1%, Mo+0.5W=2.95%

(b) Ni: 50%, Cr: 24%, Mo: 6.4%, W: 0.1%, Mo+0.5W 6.45%

(c) Ni: 51%, Cr: 22%, Mo: 10.7%, W: 0.7%, Mo+0.5W=11.05%

(d) Ni: 50%, Cr: 25%, Mo: 0.4%, W: 0%, Mo+0.5W=0.4%

Here, the content of other elements were as follows: C: 0.04% or less, Si: 1.0% or less, Mn: 0.01 to 5.0%, P: 0.03% or less, S: 0.03% or less, Cu: 0.01 to 4.0%, Al: 0.001 to 0.30%, and N: 0.005 to 0.50%.

The high alloy having the above chemical composition was used to produce billets each having an average outside diameter of 213 to 330 mm and an average wall thickness of 50 to 110 mm, which was heated to 1130 to 1270° C. Then, billets were subjected to extrusion tests which run at an extrusion ratio of 3 to 10 and an extrusion speed of 110 to 170 mm/s.

Example 1

The extrusion tests were performed using the high alloy having main components shown in the above (a). The obtained extruded tubes were inspected on their inside surfaces for occurrence of melting cracking by ultrasonic testing and visual observation specified in JIS G0582. The test conditions including the billet heating temperature and the results of melting cracking evaluation are shown in Table 2.

TABLE 2

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| A1 | 1130 | 213 | 50 | 25591 | 9.5 | 120 | 1283.6 | Suitable | ○ |
| A2 | 1130 | 213 | 55 | 27287 | 10 | 150 | 1277.0 | Suitable | ○ |

TABLE 2-continued

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| A3 | 1130 | 257.5 | 70 | 41213 | 5 | 130 | 1266.5 | Suitable | ○ |
| A4 | 1130 | 257.5 | 80 | 44588 | 6 | 170 | 1255.8 | Suitable | ○ |
| A5 | 1130 | 295.5 | 70 | 49565 | 4 | 110 | 1259.0 | Suitable | ○ |
| A6 | 1130 | 295.5 | 80 | 54134 | 5 | 140 | 1248.1 | Suitable | ○ |
| A7 | 1130 | 330 | 65 | 54087 | 5 | 120 | 1250.7 | Suitable | ○ |
| A8 | 1130 | 330 | 70 | 57148 | 6 | 140 | 1243.0 | Suitable | ○ |
| A9 | 1150 | 213 | 50 | 25591 | 8 | 110 | 1286.5 | Suitable | ○ |
| A10 | 1150 | 213 | 55 | 27287 | 10 | 130 | 1279.6 | Suitable | ○ |
| A11 | 1150 | 257.5 | 60 | 37209 | 6 | 130 | 1270.7 | Suitable | ○ |
| A12 | 1150 | 257.5 | 70 | 41213 | 6 | 140 | 1264.1 | Suitable | ○ |
| A13 | 1150 | 295.5 | 60 | 44368 | 5 | 110 | 1264.9 | Suitable | ○ |
| A14 | 1150 | 295.5 | 70 | 49565 | 6 | 130 | 1254.4 | Suitable | ○ |
| A15 | 1150 | 330 | 70 | 57148 | 6 | 120 | 1245.6 | Suitable | ○ |
| A16 | 1150 | 330 | 70 | 57148 | 6 | 150 | 1241.7 | Suitable | ○ |
| A17 | 1180 | 213 | 50 | 25591 | 9.5 | 120 | 1283.6 | Suitable | ○ |
| A18 | 1180 | 213 | 55 | 27287 | 10 | 150 | 1277.0 | Suitable | ○ |
| A19 | 1180 | 257.5 | 70 | 41213 | 5 | 130 | 1266.5 | Suitable | ○ |
| A20 | 1180 | 257.5 | 80 | 44588 | 6 | 170 | 1255.8 | Suitable | ○ |
| A21 | 1180 | 295.5 | 70 | 49565 | 5 | 110 | 1258.0 | Suitable | ○ |
| A22 | 1180 | 295.5 | 80 | 54134 | 6 | 130 | 1248.3 | Suitable | ○ |
| A23 | 1180 | 330 | 65 | 54087 | 6 | 120 | 1249.7 | Suitable | ○ |
| A24 | 1180 | 330 | 70 | 57148 | 6 | 150 | 1241.7 | Suitable | ○ |
| A25 | 1210 | 213 | 50 | 25591 | 8 | 120 | 1285.2 | Suitable | ○ |
| A26 | 1210 | 213 | 55 | 27287 | 10 | 120 | 1280.9 | Suitable | ○ |
| A27 | 1210 | 257.5 | 60 | 37209 | 6 | 120 | 1272.0 | Suitable | ○ |
| A28 | 1210 | 257.5 | 70 | 41213 | 6 | 120 | 1266.7 | Suitable | ○ |
| A29 | 1210 | 295.5 | 60 | 44368 | 4 | 120 | 1264.6 | Suitable | ○ |
| A30 | 1210 | 295.5 | 70 | 49565 | 5 | 120 | 1256.7 | Suitable | ○ |
| A31 | 1210 | 330 | 70 | 57148 | 5 | 120 | 1246.7 | Suitable | ○ |
| A32 | 1210 | 330 | 70 | 57148 | 6 | 120 | 1245.6 | Suitable | ○ |
| A33 | 1230 | 213 | 50 | 25591 | 6 | 120 | 1287.3 | Suitable | ○ |
| A34 | 1230 | 213 | 55 | 27287 | 8 | 140 | 1280.4 | Suitable | ○ |
| A35 | 1230 | 257.5 | 70 | 41213 | 9 | 120 | 1263.5 | Suitable | ○ |
| A36 | 1230 | 257.5 | 80 | 44588 | 6 | 140 | 1259.6 | Suitable | ○ |
| A37 | 1230 | 295.5 | 70 | 49565 | 5 | 120 | 1256.7 | Suitable | ○ |
| A38 | 1230 | 295.5 | 80 | 54134 | 6 | 140 | 1247.0 | Suitable | ○ |
| A39 | 1230 | 330 | 65 | 54087 | 6 | 120 | 1249.7 | Suitable | ○ |
| A40 | 1230 | 330 | 70 | 57148 | 5 | 140 | 1244.1 | Suitable | ○ |
| A41 | 1250 | 213 | 50 | 25591 | 6 | 110 | 1288.6 | Suitable | ○ |
| A42 | 1250 | 213 | 55 | 27287 | 9.5 | 130 | 1280.1 | Suitable | ○ |
| A43 | 1250 | 257.5 | 60 | 37209 | 10 | 110 | 1269.0 | Suitable | ○ |
| A44 | 1250 | 257.5 | 70 | 41213 | 5 | 130 | 1266.5 | Suitable | ○ |
| A45 | 1250 | 295.5 | 60 | 44368 | 6 | 110 | 1263.8 | Suitable | ○ |
| A46 | 1250 | 295.5 | 70 | 49565 | 4 | 130 | 1256.5 | Suitable | ○ |
| A47 | 1250 | 330 | 70 | 57148 | 5 | 110 | 1248.0 | Unsuitable | X |
| A48 | 1250 | 330 | 70 | 57148 | 5 | 130 | 1245.4 | Unsuitable | X |
| A49 | 1270 | 213 | 50 | 25591 | 6 | 120 | 1287.3 | Suitable | ○ |
| A50 | 1270 | 213 | 50 | 25591 | 9.5 | 120 | 1283.6 | Suitable | ○ |
| A51 | 1270 | 257.5 | 70 | 41213 | 5 | 120 | 1267.7 | Unsuitable | X |
| A52 | 1270 | 295.5 | 70 | 49565 | 6 | 120 | 1255.6 | Unsuitable | X |
| A53 | 1270 | 330 | 65 | 54087 | 5 | 120 | 1250.7 | Unsuitable | X |

In Table 2, the "calculated temperature" refers to the calculated right-hand side value of any of the above formulae (1) to (3), i.e. the upper limit of the heating temperature of a starting material to be extruded. Further, the "Suitable" in the conformity column means that the relationship of any of the formulae (1) to (3) is satisfied, and "Unsuitable" means that the relationship of any of the formulae (1) to (3) is not satisfied.

The "○" in the melting cracking evaluation column means that the inner surface flaws (seam flaws) resulting from grain boundary melting cracking were not observed on the inner surfaces of extruded tubes, and the "x" means that the inner surface flaws resulting from grain boundary melting cracking were observed. Here, observation of the above inner surface flaws was performed by a method of investigating the presence or absence of the inner surface flaws for each extruded tube.

The test numbers A1 to A46, A49, and A50 are the tests for Inventive Examples of the present invention in which the requirements specified in the present invention are satisfied, and the test numbers A47, A48, and A51 to A53 are the tests for Comparative Examples in which the requirements specified in the present invention are not satisfied.

For the test numbers A1 to A46, A49, and A50 which are the Inventive Examples of the present invention, the melting cracking did not occur and good inner surface qualities of the tube was obtained, but the melting cracking occurred in the test numbers A47, A48, and A51 to A53 which are Comparative Examples.

Example 2

The extrusion tests were performed using the high alloy having main components shown in the above (b). The obtained extruded tubes were inspected on their inside surfaces for occurrence of melting cracking. The test conditions and the results of melting cracking evaluation are shown in Table 3.

TABLE 3

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| B1 | 1150 | 213 | 70 | 31431 | 3 | 110 | 1257.1 | Suitable | ○ |
| B2 | 1150 | 257.5 | 80 | 44588 | 4 | 130 | 1236.0 | Suitable | ○ |
| B3 | 1150 | 295.5 | 100 | 61387 | 4 | 130 | 1213.8 | Suitable | ○ |
| B4 | 1150 | 330 | 70 | 57148 | 6 | 150 | 1214.7 | Suitable | ○ |
| B5 | 1180 | 213 | 70 | 31431 | 3 | 150 | 1251.9 | Suitable | ○ |
| B6 | 1180 | 257.5 | 80 | 44588 | 4 | 130 | 1236.0 | Suitable | ○ |
| B7 | 1180 | 295.5 | 100 | 61387 | 4 | 130 | 1213.8 | Suitable | ○ |
| B8 | 1180 | 330 | 70 | 57148 | 6 | 150 | 1214.7 | Suitable | ○ |
| B9 | 1210 | 213 | 70 | 31431 | 3 | 120 | 1255.8 | Suitable | ○ |
| B10 | 1210 | 257.5 | 80 | 44588 | 4 | 120 | 1237.3 | Suitable | ○ |
| B11 | 1210 | 295.5 | 100 | 61387 | 4 | 120 | 1215.1 | Suitable | ○ |
| B12 | 1210 | 330 | 70 | 57148 | 6 | 120 | 1218.6 | Suitable | ○ |
| B13 | 1230 | 213 | 70 | 31431 | 3 | 120 | 1255.8 | Suitable | ○ |
| B14 | 1230 | 213 | 80 | 33410 | 3.5 | 140 | 1250.1 | Suitable | ○ |
| B15 | 1230 | 257.5 | 80 | 44588 | 4 | 120 | 1237.3 | Suitable | ○ |
| B16 | 1230 | 257.5 | 80 | 445B8 | 4 | 140 | 1234.8 | Suitable | ○ |
| B17 | 1230 | 295.5 | 100 | 61387 | 4 | 120 | 1215.1 | Unsuitable | X |
| B18 | 1230 | 295.5 | 110 | 64072 | 4 | 140 | 1209.0 | Unsuitable | X |
| B19 | 1230 | 330 | 80 | 62800 | 6 | 120 | 1211.1 | Unsuitable | X |
| B20 | 1230 | 330 | 70 | 57148 | 5 | 140 | 1217.1 | Unsuitable | X |
| B21 | 1250 | 213 | 50 | 25591 | 6 | 110 | 1261.6 | Suitable | ○ |
| B22 | 1250 | 213 | 55 | 27287 | 9.5 | 130 | 1253.1 | Suitable | ○ |
| B23 | 1250 | 257.5 | 60 | 37209 | 10 | 110 | 1242.0 | Unsuitable | X |
| B24 | 1250 | 257.5 | 70 | 41213 | 5 | 130 | 1239.5 | Unsuitable | X |
| B25 | 1250 | 295.5 | 60 | 44368 | 6 | 110 | 1236.8 | Unsuitable | X |
| B26 | 1250 | 295.5 | 70 | 49565 | 4 | 130 | 1229.5 | Unsuitable | X |
| B27 | 1250 | 330 | 70 | 57148 | 5 | 110 | 1221.0 | Unsuitable | X |
| B28 | 1250 | 330 | 70 | 57148 | 5 | 130 | 1218.4 | Unsuitable | X |
| B29 | 1270 | 213 | 50 | 25591 | 6 | 120 | 1260.3 | Unsuitable | X |
| B30 | 1270 | 257.5 | 70 | 41213 | 5 | 120 | 1240.7 | Unsuitable | X |
| B31 | 1270 | 295.5 | 70 | 49565 | 6 | 120 | 1228.6 | Unsuitable | X |
| B32 | 1270 | 330 | 65 | 54087 | 5 | 120 | 1223.7 | Unsuitable | X |

The test numbers B1 to B16, B21, and B22 are the tests for Inventive Examples of the present invention in which the requirements specified in the present invention are satisfied, and the test numbers B17 to B20 and B23 to B32 are the tests for Comparative Examples in which the requirements specified in the present invention are not satisfied.

For the test numbers B1 to B16, B21, and B22 which are Inventive Examples of the present invention, the melting cracking did not occur and good inner surface qualities of the tube was obtained, but the melting cracking occurred in the test numbers B17 to B20 and B23 to B32 which are Comparative Examples.

Example 3

The extrusion tests were performed using the high alloy having main components shown in the above (c). The obtained extruded tubes were inspected on their inside surfaces for occurrence of melting cracking. The test conditions and the results of melting cracking evaluation are shown in Table 4.

TABLE 4

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| C1 | 1150 | 213 | 70 | 31431 | 3 | 110 | 1230.1 | Suitable | ○ |
| C2 | 1150 | 257.5 | 80 | 44588 | 4 | 130 | 1209.0 | Suitable | ○ |
| C3 | 1150 | 295.5 | 100 | 61387 | 4 | 130 | 1186.8 | Suitable | ○ |
| C4 | 1150 | 330 | 70 | 57145 | 6 | 150 | 1187.7 | Suitable | ○ |
| C5 | 1180 | 213 | 70 | 31431 | 3 | 150 | 1224.9 | Suitable | ○ |
| C6 | 1180 | 257.5 | 80 | 44585 | 4 | 130 | 1209.0 | Suitable | ○ |
| C7 | 1180 | 295.5 | 100 | 61387 | 4 | 130 | 1186.8 | Suitable | ○ |
| C8 | 1180 | 330 | 70 | 57148 | 6 | 150 | 1187.7 | Suitable | ○ |
| C9 | 1210 | 213 | 70 | 31431 | 3 | 120 | 1228.8 | Suitable | ○ |
| C10 | 1210 | 257.5 | 80 | 44588 | 4 | 120 | 1210.3 | Suitable | ○ |
| C11 | 1210 | 295.5 | 100 | 61387 | 4 | 120 | 1188.1 | Unsuitable | X |
| C12 | 1210 | 330 | 70 | 57148 | 6 | 120 | 1191.6 | Unsuitable | X |

TABLE 4-continued

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| C13 | 1230 | 213 | 80 | 33410 | 3.5 | 140 | 1223.1 | Unsuitable | X |
| C14 | 1230 | 257.5 | 80 | 44588 | 4 | 140 | 1207.8 | Unsuitable | X |
| C15 | 1230 | 295.5 | 110 | 64072 | 4 | 140 | 1182.0 | Unsuitable | X |
| C16 | 1230 | 330 | 70 | 57148 | 5 | 140 | 1190.1 | Unsuitable | X |
| C17 | 1250 | 213 | 50 | 25591 | 6 | 110 | 1234.6 | Unsuitable | X |
| C18 | 1250 | 257.5 | 70 | 41213 | 5 | 130 | 1212.5 | Unsuitable | X |
| C19 | 1250 | 295.5 | 70 | 49565 | 4 | 130 | 1202.5 | Unsuitable | X |
| C20 | 1250 | 330 | 70 | 57148 | 5 | 130 | 1191.4 | Unsuitable | X |
| C21 | 1270 | 213 | 50 | 25591 | 6 | 120 | 1233.3 | Unsuitable | X |
| C22 | 1270 | 257.5 | 70 | 41213 | 5 | 120 | 1213.7 | Unsuitable | X |
| C23 | 1270 | 295.5 | 70 | 49565 | 6 | 120 | 1201.6 | Unsuitable | X |
| C24 | 1270 | 330 | 65 | 54087 | 5 | 120 | 1196.7 | Unsuitable | X |

The test numbers C1 to C10 are the tests for Inventive Examples of the present invention in which the requirements specified in the present invention are satisfied, and the test numbers C11 to C24 are the tests for Comparative Examples in which the requirements specified in the present invention are not satisfied.

For the test numbers C1 to C10 which are Inventive Examples of the present invention, the melting cracking did not occur and good inner surface qualities of the tube was obtained, but the melting cracking occurred in the test numbers C11 to C24 which are Comparative Examples.

Example 4

The extrusion tests were performed using the high alloy having main components shown in the above (d). The obtained extruded tubes were inspected on their inside surfaces for occurrence of melting cracking. The test conditions and the results of melting cracking evaluation are shown in Table 5.

TABLE 5

| Test number | Billet heating temperature (° C.) | Billet average outside diameter (mm) | Billet average wall thickness (mm) | Billet cross-sectional area ($mm^2$) | Extrusion ratio (—) | Extrusion speed (mm/s) | Calculated temperature (° C.) | Conformity | Melting cracking evaluation |
|---|---|---|---|---|---|---|---|---|---|
| D1 | 1180 | 330 | 65 | 54087 | 5.5 | 120 | 1250.2 | Suitable | ○ |
| D2 | 1190 | 330 | 65 | 54087 | 6 | 120 | 1249.7 | Suitable | ○ |
| D3 | 1200 | 330 | 65 | 54087 | 6.5 | 120 | 1249.1 | Suitable | ○ |

The test numbers D1 to D3 are the tests for Inventive Examples of the present invention in which the requirements specified in the present invention are satisfied. In each of these tests, the melting cracking did not occur and good inner surface qualities of the tube were obtained.

INDUSTRIAL APPLICABILITY

According to the process for producing a high-alloy seamless tube of the present invention, a starting material to be extruded made of a high alloy having a high deformation resistance is heated to a temperature predetermined according to the contents of Mo and W and subjected to an extrusion process, the heating temperature satisfying the heating temperature conditions determined by the cross-sectional area of the starting material to be extruded, the extrusion speed, and the extrusion ratio. As a result, it is possible to prevent the occurrence of seam flaws on the tube inner peripheral surface resulting from grain boundary melting cracking. Therefore, the process of the present invention is a highly practically valuable technique in which a high-alloy seamless tube excellent in the tube inner surface quality can be produced by a hot extrusion process, and which can be widely applied in the hot production of a seamless tube.

REFERENCE SINGS LIST

1: Glass disk lubricant, 2: Die, 3: Mandrel, 4: Die holder, 5: Die backer, 6: Container, 7: Dummy block, 8: Hollow billet (billet)

What is claimed is:

1. A process for producing a high-alloy seamless tube, wherein a starting material to be extruded made of a high alloy comprising, in mass %, Cr: 20 to 30% and Ni: more than 22% and 60% or less is heated to a temperature predetermined according to the contents of Mo and W and subjected to a hot-extrusion process by the Ugine-Sejournet tube-making method, the heating temperature (T) satisfying a relationship of Formula (1), (2), or (3) as below, which is expressed in terms of the average cross-sectional area (A) of the starting material to be extruded, the extrusion ratio (EL), and the extrusion speed (V), the extrusion process being carried out with an average extrusion speed from start to finish being in the range of 80 mm/s or more to 200 mm/s or less, while with the extrusion ratio being 10 or less:

when 0%≦Mo+0.5W<4%, $$T \leqq 1343 - 0.001322 \times A - 1.059 \times EL - 0.129 \times V \quad (1);$$

when 4%≦Mo+0.5W<7%, $$T \leqq 1316 - 0.001322 \times A - 1.059 \times EL - 0.129 \times V \quad (2); \text{ and}$$

when 7%≦Mo+0.5W, $$T \leqq 1289 - 0.001322 \times A - 1.059 \times EL \times 0.129 \times V \quad (3),$$

where A and EL in Formulae (1) to (3) are determined by the following Formulae (4) and (5):

$$A = \pi \times t_0 \times (d_0 - t_0) \quad (4); \text{ and}$$

$$EL = L_1 / L_0 \quad (5),$$

given that each symbol in the above Formulae (1) to (5) means the following quantity:

Mo: Mo content in the starting material to be extruded (mass %),

W: W content in the starting material to be extruded (mass %),

T: Heating temperature of the starting material to be extruded (° C.),

A: Average cross-sectional area of the starting material to be extruded ($mm^2$), EL: Extrusion ratio (–), V: Extrusion speed (mm/s), $d_0$: Average outside diameter of the starting material to be extruded (mm), $t_0$: Average wall thickness of the starting material to be extruded (mm), $L_0$: Length of the starting material to be extruded (mm), and $L_1$: Length of the extruded tube (mm).

2. The process for producing a high-alloy seamless tube according to claim 1, wherein the heating temperature of the starting material to be extruded is 1130° C. or more.

3. The process for producing a high-alloy seamless tube according to claim 1, wherein the length of the starting material to be extruded is 1.5 m or less.

4. The process for producing a high-alloy seamless tube according to claim 3, wherein the outer surface temperature of the starting material to be extruded is 1000° C. or more.

5. The process for producing a high-alloy seamless tube according to claim 1, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

6. The process for producing a high-alloy seamless tube according to claim 2, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

7. The process for producing a high-alloy seamless tube according to claim 1, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

8. The process for producing a high-alloy seamless tube according to claim 1, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

9. The process for producing a high-alloy seamless tube according to claim 3, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

10. The process for producing a high-alloy seamless tube according to claim 4, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

11. The process for producing a high-alloy seamless tube according to claim 1, wherein the starting material to be extruded comprises, in mass %, C: 0.04% or less, Si: 1.0% or less, Mn: 0.01 to 5.0%, P: 0.03% or less, S: 0.03% or less, Ni: more than 22% and 60% or less, Cr: 20 to 30%, Cu: 0.01 to 4.0%, Al: 0.001 to 0.30%, N: 0.005 to 0.50%, and optionally one or two elements selected from a group consisted of Mo: 11.5% or less and W: 20% or less, the balance being Fe and impurities.

12. The process for producing a high-alloy seamless tube according to claim 5, wherein the starting material to be extruded contains, in mass %, one or more elements selected from a group consisted of Ca: 0.01% or less, Mg: 0.01% or less, and rare earth metals: 0.2% or less, instead of a part of Fe.

13. The process for producing a high-alloy seamless tube according to claim 6, wherein the starting material to be extruded contains, in mass %, one or more elements selected from a group consisted of Ca: 0.01% or less, Mg: 0.01% or less, and rare earth metals: 0.2% or less, instead of a part of Fe.

14. The process for producing a high-alloy seamless tube according to claim 7, wherein the starting material to be extruded contains, in mass %, one or more elements selected from a group consisted of Ca: 0.01% or less, Mg: 0.01% or less, and rare earth metals: 0.2% or less, instead of a part of Fe.

15. The process for producing a high-alloy seamless tube according to claim 8, wherein the starting material to be extruded contains, in mass %, one or more elements selected from a group consisted of Ca: 0.01% or less, Mg: 0.01% or less, and rare earth metals: 0.2% or less, instead of a part of Fe.

16. The process for producing a high-alloy seamless tube according to claim 9, wherein the starting material to be extruded contains, in mass %, one or more elements selected from a group consisted of Ca: 0.01% or less, Mg: 0.01% or less, and rare earth metals: 0.2% or less, instead of a part of Fe.

17. The process for producing a high-alloy seamless tube according to claim 10, wherein the starting material to be extruded contains, in mass %, one or more elements selected from a group consisted of Ca: 0.01% or less, Mg: 0.01% or less, and rare earth metals: 0.2% or less, instead of a part of Fe.

* * * * *

UNITED STATES PATENT AND TRADEMARK OFFICE

CERTIFICATE OF CORRECTION

PATENT NO. : 8,245,552 B2
APPLICATION NO. : 12/954223
DATED : August 21, 2012
INVENTOR(S) : Hiroaki Murakami et al.

It is certified that error appears in the above-identified patent and that said Letters Patent is hereby corrected as shown below:

On the title page, at (75) the Inventors' residences are as follows:

Hiroaki Murakami, Nishinomiya-shi (JP);
Tomio Yamakawa, Kawanishi-shi (JP);
Tadashi Douhara, Takarazuka-shi (JP);
Masayuki Sagara, Nishinomiya-shi (JP).

Column 17, line 2 (claim 1) replace $T \leqq 1289 - 0.001322 \times A - 1.059 \times EL \times 0.129 \times V$ .. (3)

with the following formula:

$T \leq 1289 - 0.001322 \times A - 1.059 \times EL - 0.129 \times V$ .. (3)

Signed and Sealed this
Eighteenth Day of December, 2012

David J. Kappos

David J. Kappos
*Director of the United States Patent and Trademark Office*